US005601197A

United States Patent [19]

Baxter

[11] Patent Number: 5,601,197

[45] Date of Patent: Feb. 11, 1997

[54] HANGING STORAGE DEVICE WITH MULTI-POSITIONAL CLIP ASSEMBLIES

[76] Inventor: Dean Baxter, 1621 Village Trail, Keller, Tex. 76248

[21] Appl. No.: 379,728

[22] Filed: Jan. 27, 1995

[51] Int. Cl.[6] ..... A47F 5/08

[52] U.S. Cl. ..... 211/117; 211/47; 211/113; 211/115; 211/196; 248/316.1; 248/316.5; 24/298

[58] Field of Search ..... 211/47, 89, 113, 211/115, 117, 118, 196; 248/316.1, 316.5; 24/298, 300

[56] References Cited

U.S. PATENT DOCUMENTS

| | | | |
|---|---|---|---|
| 337,422 | 3/1896 | Miller | 211/115 |
| 567,857 | 9/1896 | Knautz | 211/117 |
| 585,406 | 6/1897 | Rhind | 248/316.5 X |
| 784,070 | 3/1905 | Rhoads | 211/115 X |
| 1,889,002 | 11/1932 | Palicki | 211/113 |
| 2,432,957 | 12/1947 | Webster | 211/113 |
| 3,328,064 | 6/1967 | Simon | 24/298 X |
| 3,756,096 | 9/1973 | Bolden | 248/316.5 X |
| 4,515,278 | 5/1985 | DeVroom | 248/316.1 X |
| 5,005,796 | 4/1991 | Downie | 248/316.5 X |
| 5,072,904 | 12/1991 | Taylor | 211/89 X |
| 5,118,065 | 6/1992 | Becklund et al. | 248/316.5 |
| 5,249,770 | 10/1993 | Louthan | 248/205.2 X |
| 5,458,249 | 10/1995 | Shang-Lu | 211/196 X |

OTHER PUBLICATIONS

Plastic Chain Organizer shown on p. 89 of Final Christmas 1994 Catalog of "Current".

*Primary Examiner*—Leslie A. Braun
*Assistant Examiner*—Richard M. Smith
*Attorney, Agent, or Firm*—Chase & Yakimo

[57] ABSTRACT

A hanger device comprises a plurality of clip assemblies slidable along a support such as a rope or the like. Each assembly comprises a plurality of clamps rotatable about the central axis of the rope by means of a collar rotatably mounted to a base, the base receiving a portion of the rope in longitudinal extension therethrough. Each clamp is further rotatably mounted about a shaft extending from the collar and through a hub associated with the clamp. Each clamp is further pivotal about a pivot pin extending through first and second arms extending from the hub. The plurality of clamp positions, relative to the rope, allows for various articles, such as ball caps, towels, etc. to be displayed in various positions along and about the support.

20 Claims, 9 Drawing Sheets

HANGING STORAGE DEVICE WITH MULTI-POSITIONAL CLIP ASSEMBLIES

BACKGROUND OF THE INVENTION

This invention relates to a hanger device for supporting articles and, more particularly, to a hanger device presenting a plurality of hanger assemblies for selectable multi-positioning along an elongated rope or other support.

Various devices have been proposed for hanging a plurality of articles in a defined area whether for storage, display or other purposes. One device, referred to as a plastic chain organizer, proposes the use of a six foot plastic chain with 20 permanent clips attached thereto. Toys, towels, hats or other devices may then be attached to such clips. However, one problem with such a device is that the permanent attachment of the clips along the vertical chain, precludes any variations of the clip positions along the chain. Thus, the position and/or type of articles hung therefrom are restricted.

In response thereto I have invented a clip assembly having a plurality of clamps which is designed to be slidable along the length of a rope or other support such that the user can vary the spacing between each clip assembly. Each clip assembly includes a plurality of clamps rotatably mounted about a base, the base receiving a rope in a friction fit relationship extending therethrough. The rotatable base allows the user to select the relative position of the clamps relative to the rope passing therethrough. Each clamp is further pivotal about an axis passing through the base and an axis displaced from the base. Thus, each clamp can be adjusted about the support and axes relative thereto. The various user-selectable positions of the clip assemblies and clamps therein allow the user to hang items such as hats, ball caps or the like in various selectable displays. The rope presents a loop or hook at its upper end for hanging from other objects.

It is therefore an object of this invention to provide a display device having a plurality of hanger assemblies thereon.

Another object of this invention is to provide a display device, as aforesaid, the hanger assembly being slidable along a rope or other support passing therethrough.

Still another object of this invention is to provide a device with hanger assemblies, as aforesaid, each hanger assembly having a plurality of clamps therein.

A further object of this invention is to provide a hanger assembly, as aforesaid, which can be individually used with various supports.

Another object of this invention is to provide a hanger device, as aforesaid, the individual clamps being rotatable about the rope and/or being rotatable about an axis passing through the rope and/or being pivotable about an axis displaced from the rope.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
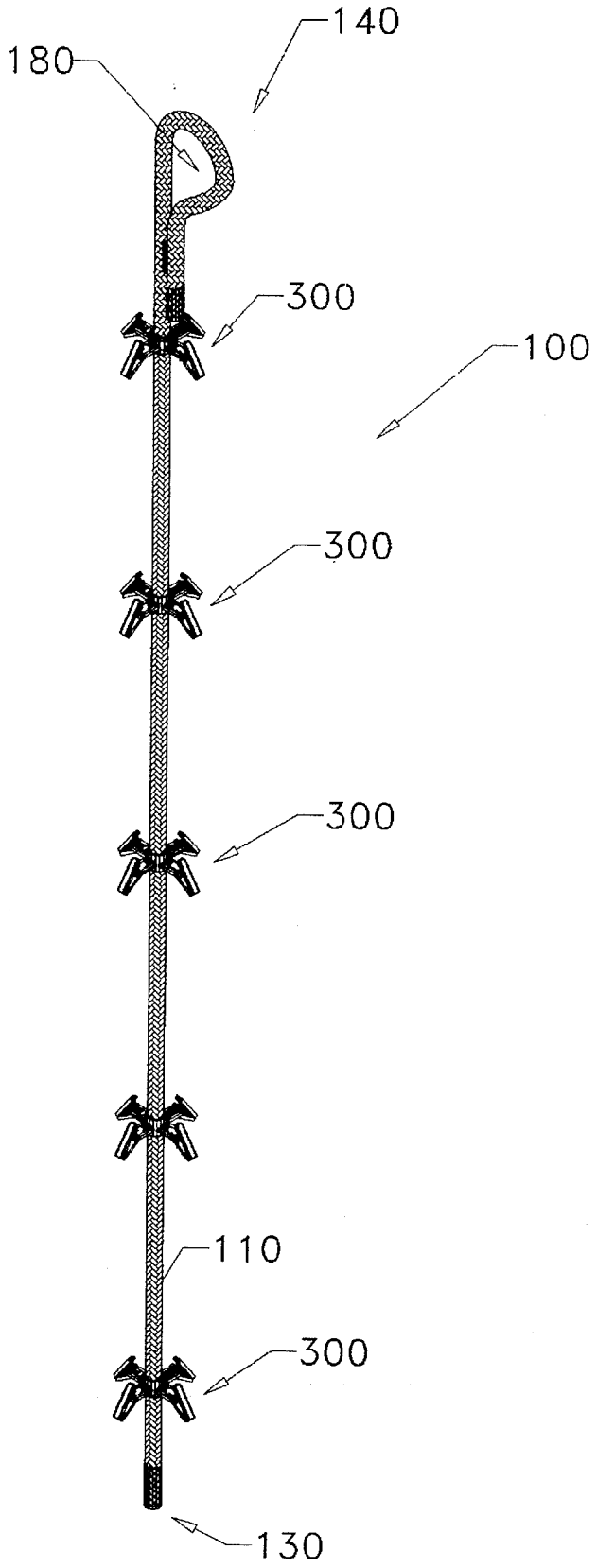
FIG. 1 is a front view of the storage/display device showing a plurality of clip assemblies positioned along a rope, the rope having a loop at the upper end thereof.
Figure 2:
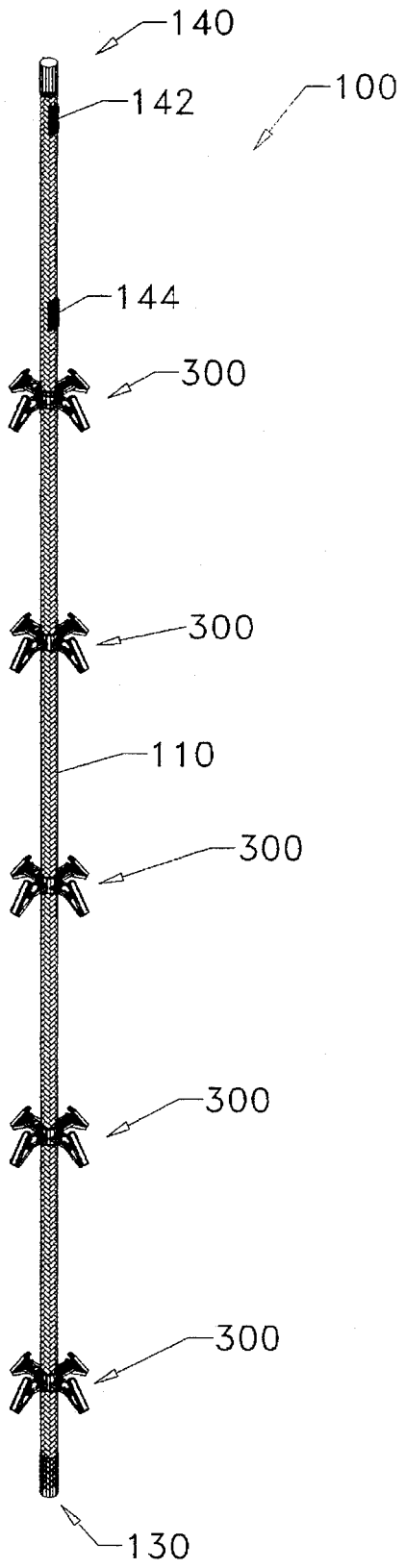
FIG. 2 is view of the device of FIG. 1, the upper end being in an unfolded position.

Turning more particularly to the drawings, a first embodiment 100 of the device is shown in FIG. 1 as comprising a rope 110 having a plurality of clip assemblies 300 longitudinally spaced in a vertical direction therealong. The upper end 140 of rope 110, as best seen in FIG. 2, presents first and second spaced-apart Velcro® mating fasteners 142, 144. Accordingly, the upper end 140 of rope may be folded on itself and secured by mating of the fasteners 142, 144 so as to present a loop 180 for connection of the hanger device 100 to other objects.

Figure 3:
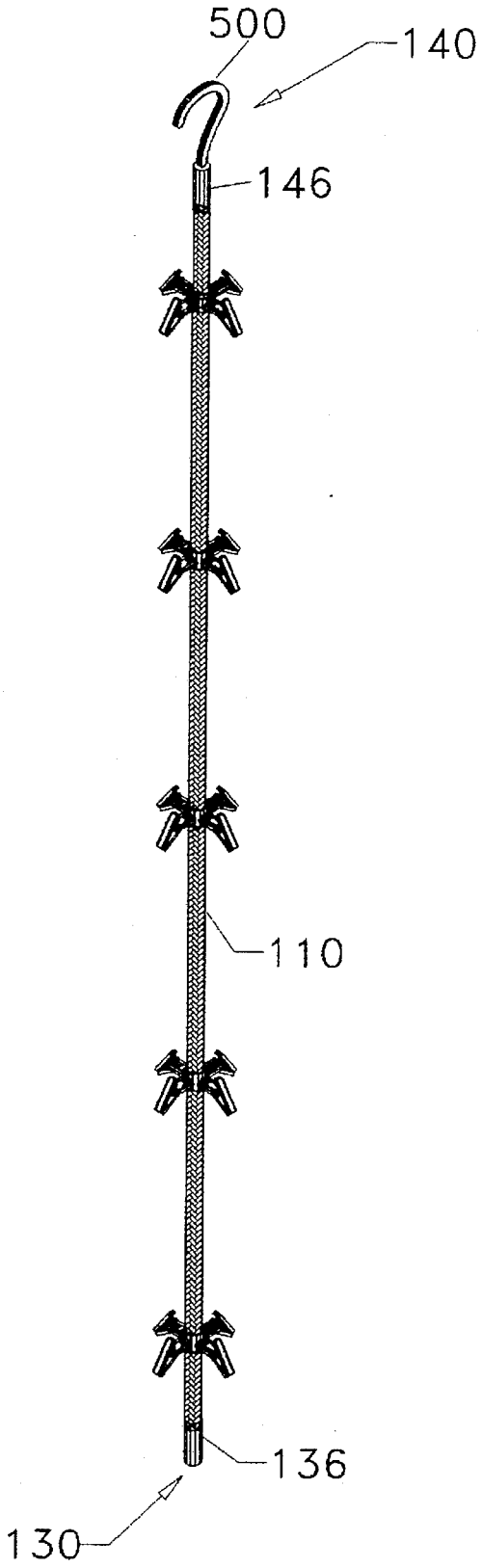
FIG. 3 is an alternative embodiment of the device of FIG. 1 showing the use of a hook at the upper end thereof.
Figure 4:
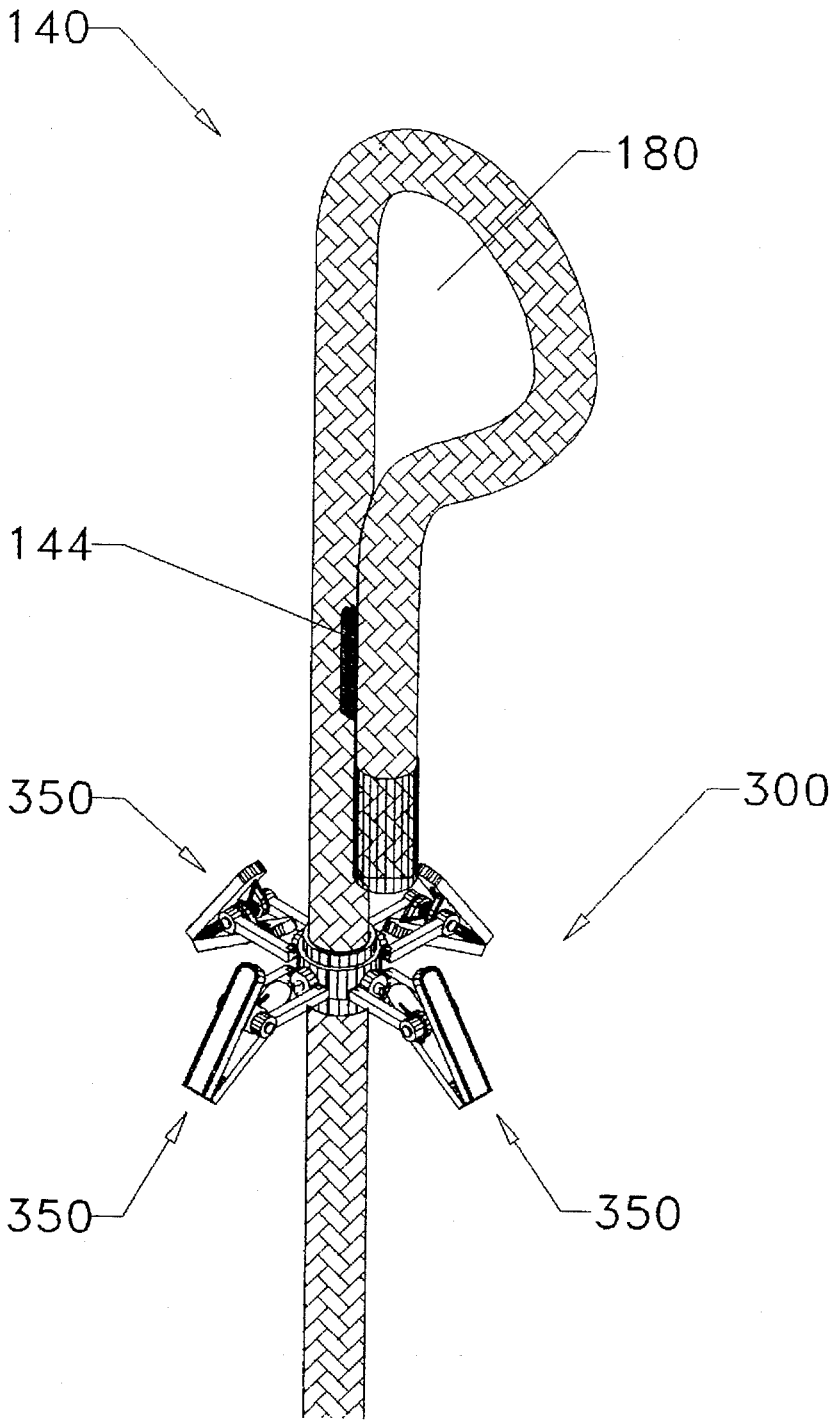
FIG. 4 is a perspective view of the upper end of the FIG. 1 device on an enlarged scale.
Figure 5:
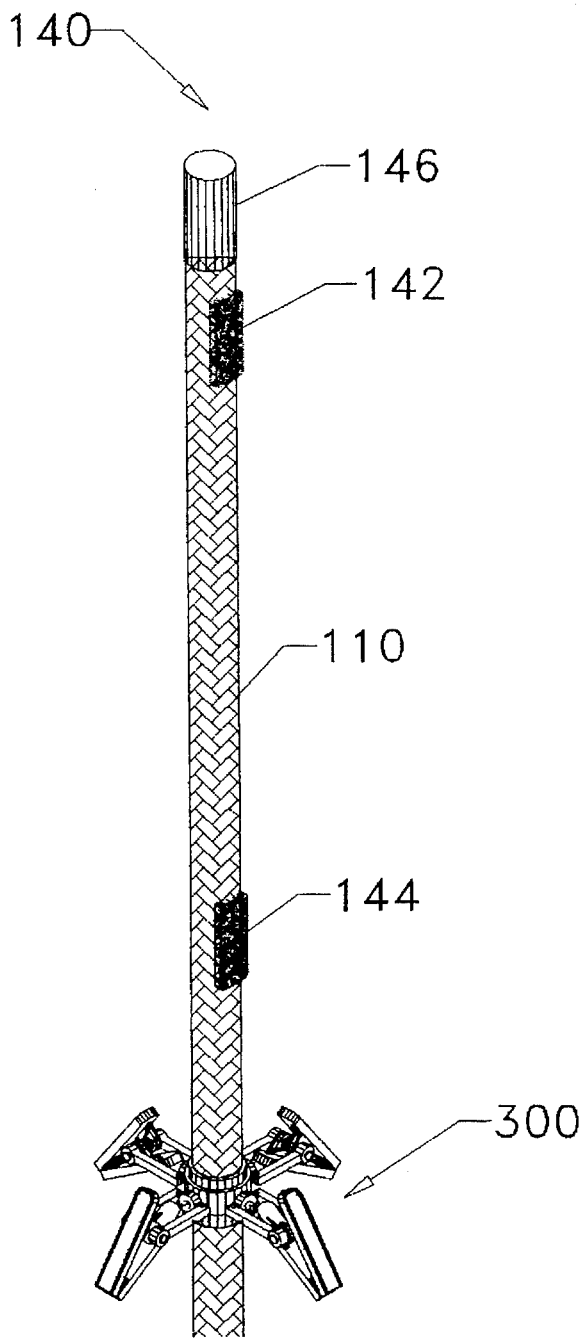
FIG. 5 is a view of the upper end of the device of FIG. 2 on an enlarged scale.
Figure 6:
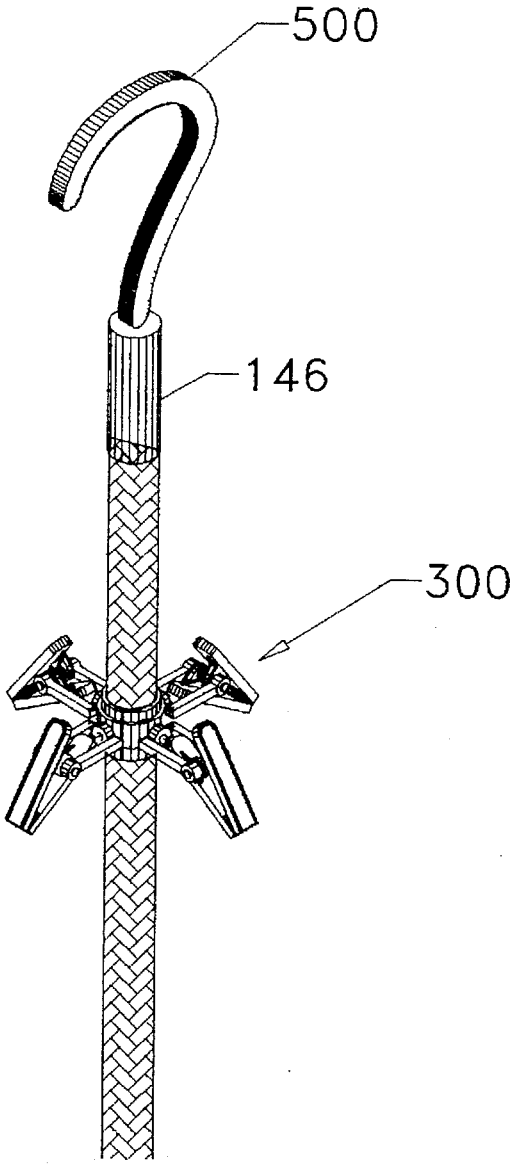
FIG. 6 is a view of the upper end of the device of FIG. 3 on an enlarged scale.

Alternatively, the rope 110 may have a hook 500 secured at the upper end 140 (FIG. 3). It is understood that the upper 140 and lower 130 ends of the rope 110 have end caps 146, 136 thereon to prevent fraying of the rope. Other structures may be used to reinforce the rope 110 ends 130, 140 such as tape, stitching, etc.

Figure 7:
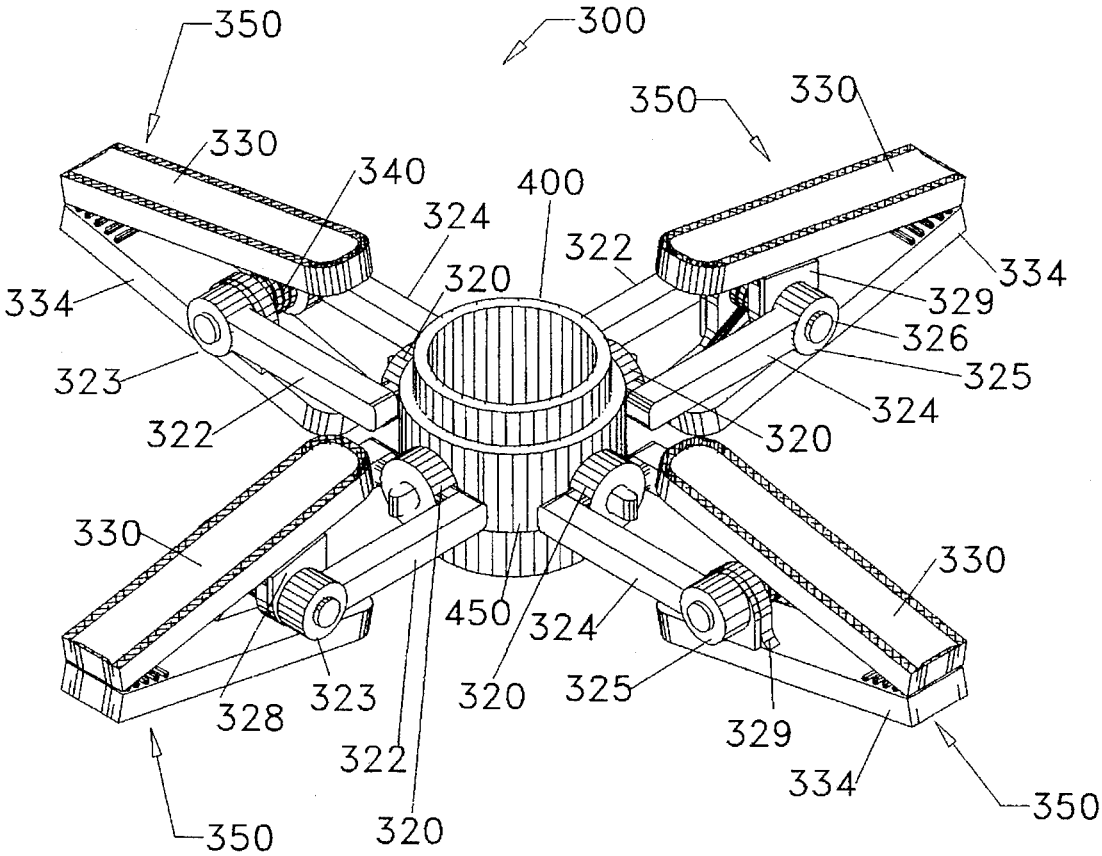
FIG. 7 is a perspective view of one clip assembly on an enlarged scale.
Figure 8:
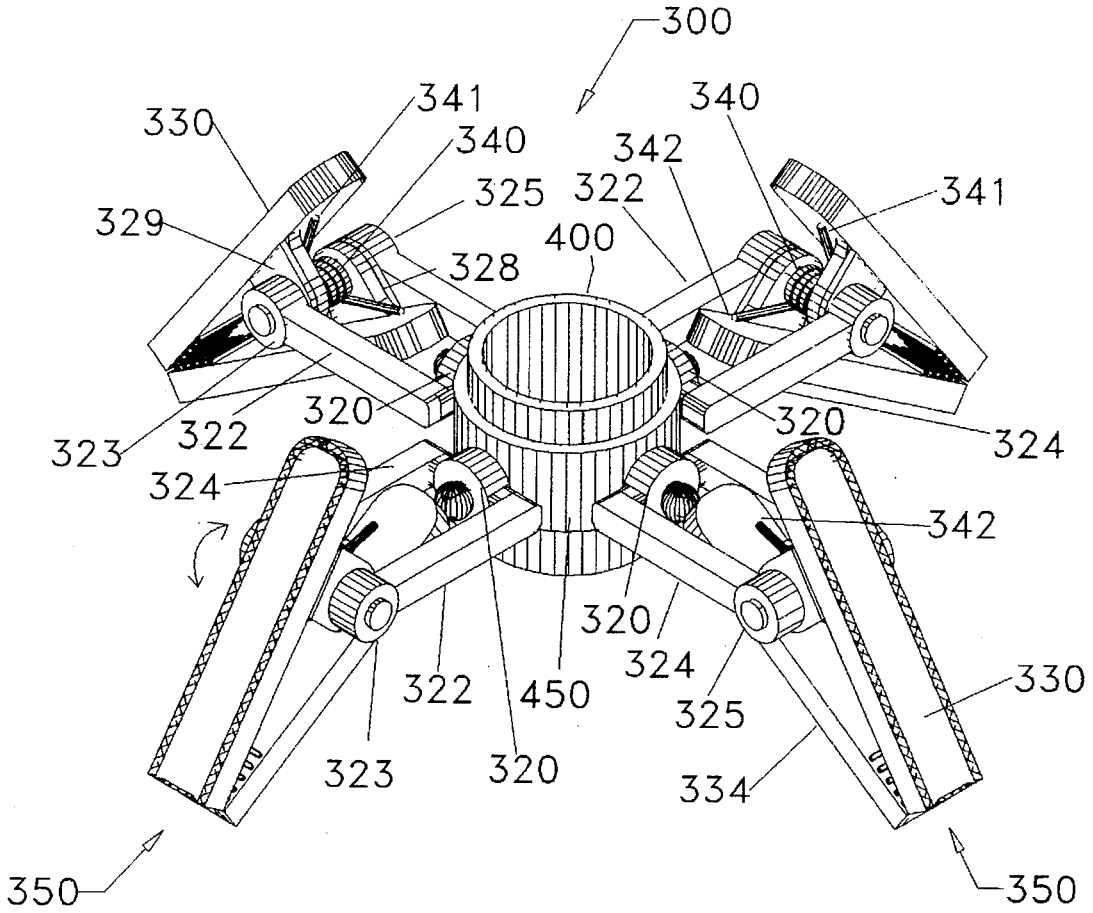
FIG. 8 is view of the clip assembly of FIG. 7 showing the individual clamps in an alternative position as provided by rotation of each clamp about a pin passing through each clamp.
Figure 9:
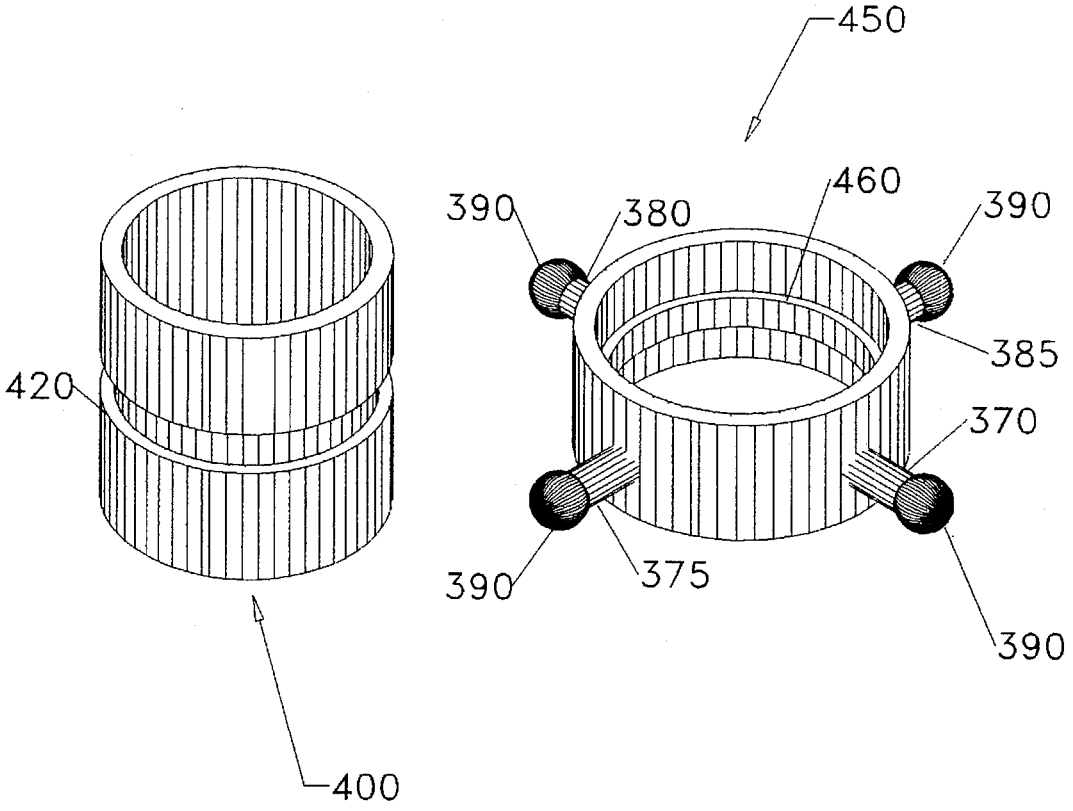
FIG. 9 is a view of the base/hub assembly of each clip assembly.

The clip assembly 300 is best shown in FIGS. 7 and 8. Each clip assembly 300 is connected to a base as presented by ring 400 and collar 450. The ring 400 has an inside diameter which engages, via an efficient friction fit relationship, a support passing therethrough such as the rope 110. It is understood that other types of supports may be used of various configurations with the inside diameter of ring 400 being variously configured according to the support utilized. The ring 400 presents an intermediate circular race 420 along the mid-portion thereof.

The collar 450 presents a circular flange 460 about its inside diameter, the flange 460 configured to slide about race 420. Thus, the entire collar 450 and clip assembly 300 mounted thereto can be rotated relative to the ring 400 and rope 110 passing therethrough.

Normally extending from the collar 450 are four shafts 370, 375, 380, 385 at 90° intervals around the outside diameter of the collar 450. Each shaft extends along an imaginary axis passing through the collar. Each shaft has a rounded end 390 at the shaft free end which is displaced from collar 450. The shaft extends through an aperture in a mounting hub or cap 320 with the end 390 maintaining the cap 320 in place. Cap 320 is then rotatable about the respective shaft extending therethrough.

Extending from the cap 320 are first and second clamp mounting arms 322, 324. Located at the distal end of each arm 322, 324, relative to collar 450, is a mounting hub 323, 325. The hubs 323, 325 support the ends of a pivot pin 326 extending therethrough. Pin 326 lies along an imaginary axis displaced from the base 400. The pin 326 further extends through flanges 328, 329 adjacent the hub 323, 325, each flange being a lobe respectively extending from the underside of a jaw 330, 334 forming each individual clamp 350. A spring 340 is wrapped about pin 326 between flanges 328, 329. The spring 340 presents free ends 341, 342 which bear against the proximal/handle ends of each jaw. Thus, the handle ends are urged in opposite directions about pin 326 so as to urge the distal/gripping ends of each jaw 330, 334 in a closed functional relationship about an article placed therebetween.

As such, each individual clamp 350 is rotatable about the pin 326 and is further rotatable by rotation of end cap 320 about the respective shaft passing therethrough. Moreover, the clamps 350 of each clip assembly 300 are rotatable about the rope 110 as provided by rotation of collar 450. Finally, the base, as presented by ring 400 surrounded by rotatable collar 450, may be slidable to various selectable positions along the extent of rope 110 and held in place by the friction fit relationship with rope 110. Thus, various positions of the clip assemblies 300 and each clamp 350 therein are provided which allow the user to display articles supported by clamps 350 at a myriad of positions along the rope 110 or other support.

Also, it can be seen that each embodiment of the device can be hung from various objects either by the internally made loop 180 or the hook 500 so that various articles may then be clamped thereto and displayed according to the desire of the user, such as ball caps, towels, handkerchiefs and the like.

It is understood that although the above-described clip assembly 300 has been shown in connection with a rope other supports may also be used. Also, other types of clamps/hangers may be utilized so as to support articles therefrom. It is further understood that the support utilized need not always be in a vertical position.

It is to be understood that while certain forms of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A hanger device for connection to a support comprising:

a sleeve;

means for connecting said sleeve about a support;

a collar;

means for rotatably mounting said collar about said sleeve in a first plane generally normal to a central axis passing through the support;

means for rotatably connecting at least one clamp to said collar in rotation in a second plane generally normal to said first plane;

means for pivotally mounting said rotatable clamp in movement about an imaginary axis spaced from said collar in a third plane generally normal to said second plane.

2. The device as claimed in claim 1 wherein said rotatable mounting means comprises:

a shaft having an end displaced from said collar;

a hub associated with said clamp and rotatably mounted about said end of said shaft.

3. The device as claimed in claim 1 wherein said pivotable mounting means comprises:

a pin;

means for mounting said pin to said collar in extension about said imaginary axis displaced from said collar;

means on said clamp for mounting said clamp about said pin.

4. The device as claimed in claim 3 wherein said means for mounting said clamp about said pin comprises a flange extending from said clamp to receive a portion of said pin extending therethrough.

5. The device as claimed in claim 1 wherein said means for rotatably mounting said collar to said base comprises:

a race about said base;

a complementary flange about said collar for movement about said race.

6. A hanger device comprising:

an elongated support having first and second ends;

at least one clip assembly mounted to said support, each clip assembly comprising:

a base having an aperture for receiving a portion of said support in extension therethrough;

at least one clamp assembly mounted to said base, each clamp assembly comprising:

a clamp;

first rotatable mounting means intermediate said base and said clamp for connecting said clamp to said base in rotatable movement about a first imaginary axis passing through said base, said first mounting means and a central imaginary axis of said support;

second mounting means associated with said first mounting means for pivoting said rotatable clamp to a selectable functional position about a second imaginary axis spaced from said base for subsequent clamp use, said second axis traversing said first imaginary axis.

7. The device as claimed in claim 6 wherein said second mounting means comprises:

at least one arm extending from said first mounting means and presenting a first end adjacent said base and a free end displaced from said base;

a pivot pin extending through said arm free arm end and along the second imaginary axis spaced from said base;

flange means on said clamp for receiving a portion of said pivot pin therein, said flange means movable about said pivot pin to provide said pivotable movement of said clamp to said selectable functional position.

8. The device as claimed in claim 7 wherein said first mounting means comprises:

a shaft extending from said base and along said first imaginary axis passing through said base and said central axis of said support, said shaft presenting a free end displaced from said base;

a hub at said first end of said at least one arm, said hub mounted to said free end of said shaft in rotatable movement about said shaft.

9. The device as claimed in claim 1 further comprising means for mounting said clip assembly in rotatable movement about said support.

10. The device as claimed in claim 9 wherein said clip assembly mounting means comprises:

a collar forming a part of said base;

means for rotatably mounting said collar about said base, said first and second mounting means of each clamp assembly mounting said clamp to said collar.

11. The device as claimed in claim 8 wherein said clamp comprises:

a first jaw having first and second ends;

a second jaw having first and second ends.

12. The device as claimed in claim 11 wherein said flange means comprises a lobe extending from at least one of said jaws for receiving a portion of said pivot pin therethrough.

13. The device as claimed in claim 12 further comprising means for biasing said first ends of said first and second jaws in movement in opposed directions about said pivot pin, said bias means urging said second ends of each jaw in a contiguous relationship to grasp an article positioned between said jaws.

14. The device as claimed in claim 13 wherein said bias means comprises a spring mounted about said pivot pin and presenting first and second spring ends bearing against said first ends of said first and second jaws.

15. The device as claimed in claim 6 wherein said base is slidable along said support.

16. The device as claimed in claim 6 wherein said support comprises a rope.

17. The device as claimed in claim 16 further comprising first and second mating fasteners at an upper end of said rope, said mating of said fasteners presenting a loop at said upper rope end.

18. The device as claimed in claim 6 wherein said first mounting means comprises:

a shaft extending from said base and along said first imaginary axis;

a hub rotatably mounted about said shaft;

at least one arm rotatable within said hub and presenting an end displaced from said base, said second mounting means positioned at said arm end.

19. The device as claimed in claim 18 wherein said second mounting means comprises:

a pivot pin extending through said arm end and rotatable therewith, said pivot pin extending along said second imaginary axis;

bracket means on said clamp for receiving a portion of said pivot pin therein, said bracket means movable about said pivot pin to provide said pivotable movement of said clamp to said selectable functional position.

20. A hanger device comprising:

an elongated support having first and second ends;

at least one clip assembly mounted to said support, each clip assembly comprising:

a sleeve encased about a portion of said support extending therethrough;

at least one clamp assembly mounted to said sleeve, each clamp assembly comprising:

a clamp;

first rotatable mounting means intermediate said base and said clamp for connecting said clamp to said sleeve in rotatable movement about a first imaginary axis passing through said sleeve, said first mounting means and a central imaginary axis of said support;

second mounting means associated with said first mounting means for pivoting said rotatable clamp to a selectable functional position about a second imaginary axis spaced from said sleeve for subsequent clamp use, said second axis traversing said first imaginary axis.

* * * * *